United States Patent [19]

Leon et al.

[11] 4,438,482

[45] Mar. 20, 1984

[54] ILLUMINATING DEVICE

[76] Inventors: Thomas B. Leon, 4028 Norton Ave., Oakland, Calif. 94602; Michael D. Arpin, 6427 Thornhill Dr., Oakland, Calif. 94611

[21] Appl. No.: 498,692

[22] Filed: May 31, 1983

[51] Int. Cl.[3] ..... F21L 15/08

[52] U.S. Cl. ..... 362/103; 362/184; 362/186; 362/190; 362/191; 362/208; 362/249; 362/382; 362/396

[58] Field of Search ..... 362/103, 184, 186, 190, 362/191, 208, 249, 382, 396

[56] References Cited

U.S. PATENT DOCUMENTS

| | | | |
|---|---|---|---|
| 1,597,823 | 8/1926 | Randolph | 362/103 |
| 2,531,585 | 11/1950 | Pope | 362/105 X |
| 2,557,663 | 6/1951 | Knode | 362/103 |
| 3,946,505 | 3/1976 | Dana | 362/103 |
| 3,947,676 | 3/1976 | Battilana et al. | 362/105 |
| 4,128,861 | 12/1978 | Pelengaris | 362/103 |

*Primary Examiner*—Stephen J. Lechert, Jr.

[57] ABSTRACT

A shoe mounted lighting device utilizes a resilient clamping device for attaching the device to the heel of a shoe. Incandescent lights are mounted on the side of the clamping device viewable from in front, to the side and in back of the user. The incandescent lamps can be mounted on wands projecting outwardly to the side of the user or mounted on the surface of the clamping device viewable from the front, side and rear of the user.

3 Claims, 6 Drawing Figures

ILLUMINATING DEVICE

BACKGROUND OF THE PRIOR ART

This invention relates generally to battery powered lighting devices and in particular to battery powered lighting devices for mounting on the foot or shoe of the user.

Battery operated lighting devices for mounting on the shoes of the wearer are known, however, most devices of the prior art were designed to be integral with the shoe of the wearer. In most cases the battery was placed in the heel and the lighting device place in the front of the shoe. One device are arranged to clamp over the vamp of a shoe and project a light beam forward of the user.

Another device used the heel as the mount for both the incandescent light and the battery with the incandescent light beam projecting forward of the heel under the instep.

Nearly all of the prior art illuminating devices mounted on a shoe were of a decorative nature which were designed to dazzle or fascinate the onlooker. The illuminating device of the present invention is designed to be used as a safety device for runners, joggers, cycles, persons walking at night, ice skaters, roller skaters, and the like.

SUMMARY OF THE INVENTION

The illuminating device of the present invention comprises a generally U-shaped resilient member adapted to engage a shoe proximate the heel thereof and having a container for housing one or more batteries therein disposed on the side of the U-shaped member, the battery container having one or more receptacles electrically connected to to the batteries for receiving various types of incandescent illuminating devices which may be either mounted on the surface of said housing or be mounted on the end of a wand or extension member and project outwardly therefrom.

It is therefore an object of the present invention to provide an illuminating apparatus which mounts on the shoe of the wearer.

It is a further object of the present invention to provide a shoe mounted lighting device in which the light sources are visible to the front, side and rear of the wearer.

It is still a further object of the present invention to provide a shoe mounted lighting device incorporating its own battery powered source and adapted to receive various configurations or illuminating devices visible through a 180 degree arc from the front, to side, to rear of the user.

It is yet another object of the present invention to provide a shoe mounted lighting device in which the incandescent light source is mounted at the end of an extension member projecting outwardly to the side of the wearer.

It is still another object of the present invention to provide a shoe mounted lighting device which is easily installed on and removed from the shoe of the wearer.

These and other objects of the present invention will become manifest upon careful study of the following detailed description when taken together with the drawings.

DESCRIPTION OF THE PREFERRED EMBODIMENT

Figure 1:
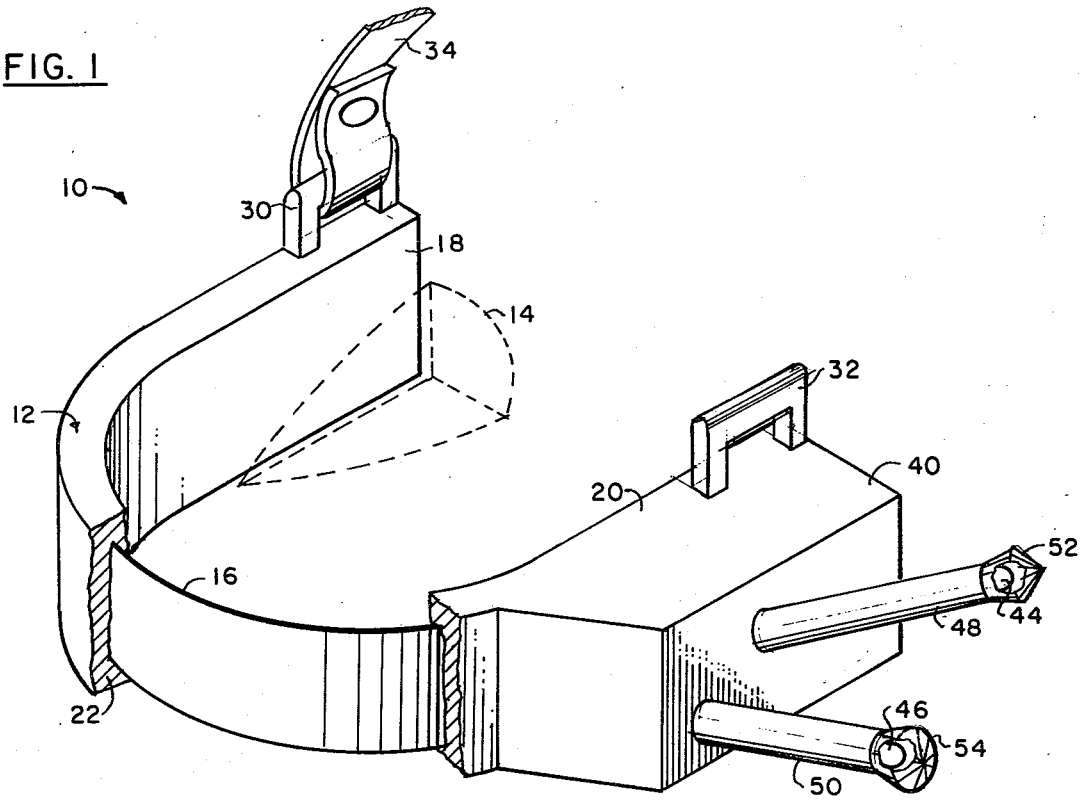
FIG. 1 is an isometric partial cutaway view of the typical shoe mounted lighting device of the present invention.

With reference to FIG. 1 there is illustrated an isometric view of the illuminating apparatus of the present invention comprising a generally U-shaped member 12 adapted to engage the heel 14 (shown in dashed line) of a wearer's shoe and containing a resilient spring U-shaped member 16 biased to force sides 18 and 20 against heel 14.

Covering 22 around spring 16 can be of any generally soft elastomer material such as rubber, neoprene or like plastic. The material is of such a softness and resilience as to be able to frictionally engage heel 14 and prevent any physical damage to the sides of heel 14. A pair of strap holders or anchors 30 and 32 are attached to sides 18 and 20 respectively and are used as an anchor for straps 34. Straps 34 are adapted to fasten over the instep and further to hold illuminating device 10 in engagement with the heel 14 of the shoe of the wearer.

Figure 2:
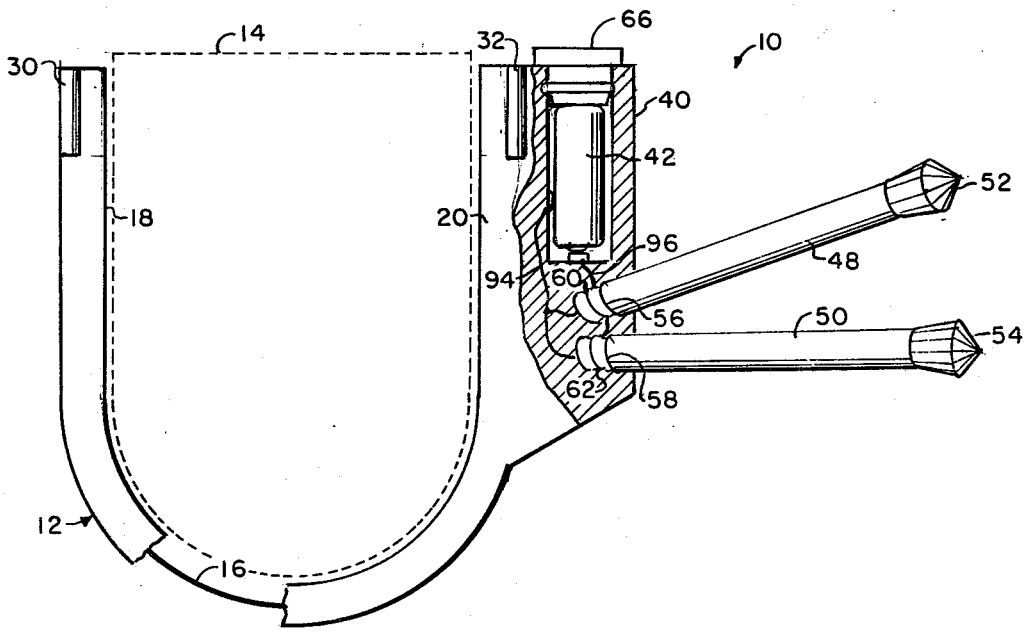
FIG. 2 is a plan view of the typical shoe mounted lighting device of the present invention as shown on FIG. 1.

A housing 40 is disposed along one side 20 of U-shaped member 12 and is adapted to project upwardly from the side of the shoe of the wearer. Housing 40 also define a container for battery or batteries 42 which are used to energize light sources 42 as shown in FIG. 2.

Lighting device 10 further comprises a pair of light sources 44 and 46, respectively, mounted at the ends of wands or extension members 48 and 50. Light sources 44 and 46, respectively, are contained in light diffusers or diffractors 52 and 54 respectively.

Figure 6:
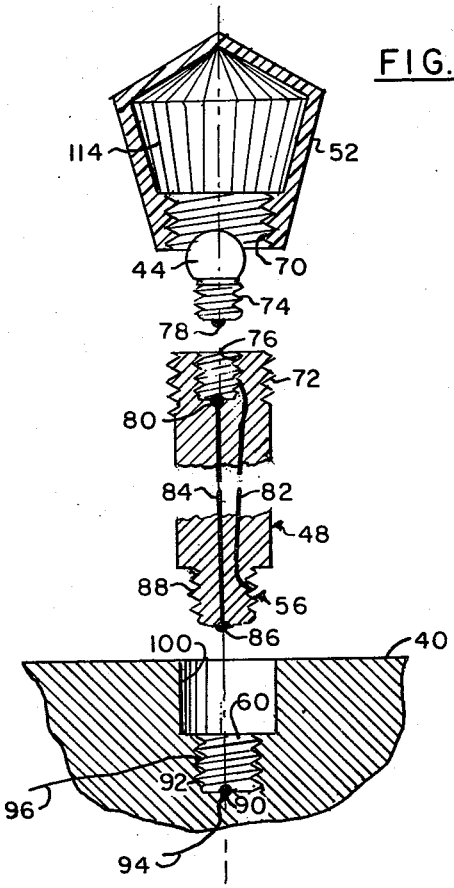
FIG. 6 is an exploded view of a typical wand or extension member.

The bottom ends of wands or extension members 48 and 50 comprise screw sockets 56 and 58, shown in greater detail in FIG. 6 for wand 48. A pair of screw receptacles, respectively, receptacles 60 and 62, are imbedded in housing 40 and are wired to batteries 42 to provide a continuous electric circuit to light sources 44 and 46.

A cap 66 provides the closure for the compartment containing battery 42.

Although a screw receptacle and base are illustrated as the means for connecting the light source and extension member 48 to housing 40, it can be readily seen that other types of connector methods could be used, such as, a bayonet type friction held contact or other mechanical device.

With reference to FIG. 6 there is illustrated an exploded view of a typical wand or extension member assembly comprising a diffuser or diffractor 52 having screw threads 70 adapted to engage screw threads 72 proximate the upper end of extension member 48. Screw threads 74 on the base of light source 44 are adapted to engage the screw threads of receptacle 76 and to have base contact 78 electrically contact socket contact 80. This creates an electrical circuit through conductors 82 and 84 which are connected to center contact 86 and screw threads 88 of lower socket 56. Center contact 86 and screw threads 88 of lower socket 56 are, in turn, electrically connected to center contact 90 of screw receptacle 60 and socket threads 92 of receptacle socket 16 thereby creating electrically circuit through conductors 94 and 96. Electrical conductors 94 and 96 are, in turn, connected to the positive and negative electrodes of battery 42.

In lieu of a switch, light sources 44 and 46 can be disconnected from battery 42 by unscrewing extension member 48 from receptacle socket 60 to disconnect contact 86 from contact 90.

It will be noted that hole 100 in housing 40, at the base of which is located socket receptacle 60, is adapted to have an inside diameter slightly less than the outside diameter of extension member 48 so that as extension member 48 is inserted into hole 12 and screwed into socket receptacle 60, it will frictionally engage the sides of hole 100 and be retained therein in spite of any vibration or movement of illuminating device 10 while it is strapped onto the shoe of the wearer.

Figure 3:
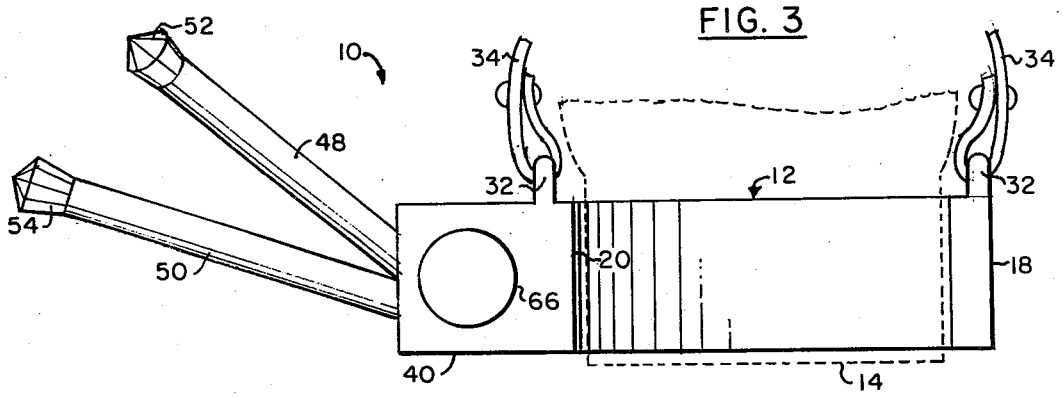
FIG. 3 is a front elevational view of the typical shoe mounted lighting device of the present invention as illustrated in FIG. 1.
Figure 4:
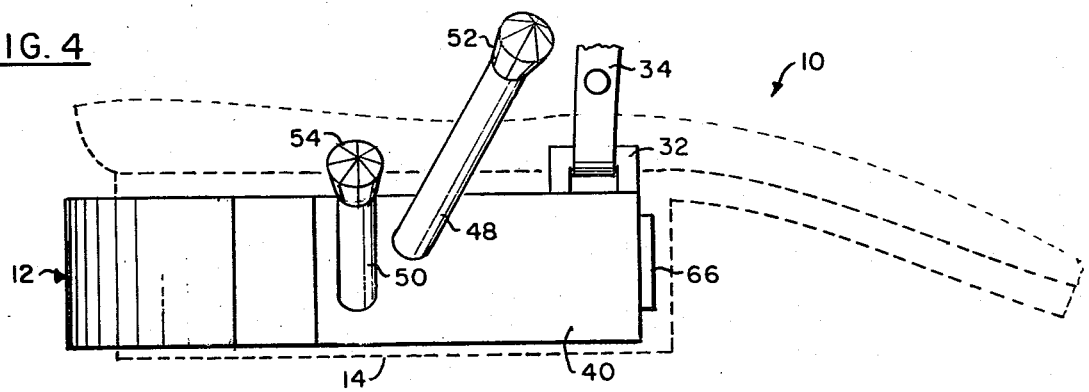
FIG. 4 is a side view of the typical shoe mounted lighting device of the present invention as illustrated in FIG. 1.

With reference to FIGS. 3 and 4, there is a further illustration in FIG. 3 of a front elevational view of the apparatus illustrated in FIG. 1. In FIG. 4, there is illustrated a side elevational view of the apparatus shown in FIG. 1.

It can be seen that extension members 48 and 50 project outwardly from housing 40 at different angles vertically and horizontally. Thus, extension member 50 projects outwardly from housing 40 on a vertical plane which is generally perpendicular to housing 40 and upwardly at an angle thereto.

Extension member 48 projects outwardly from housing 48 not only upward at a vertical angle but also forward at a horizontal angle to the side of housing 40.

Because of this, there is an ability for one to see the light sources shining through diffusers 52 and 54 in all directions to the front, to the side, and to the rear within an arc which is somewhat greater than 180 degrees forward, to the side, and to the rear of the wearer.

For this configuration, a person wearing the illuminating device of the present invention, one on the right shoe and one on the left shoe, each projecting outwardly from the wearer, the wearer can be readily seen at night by vehicles approaching from the rear, side and front of the wearer.

Figure 5:
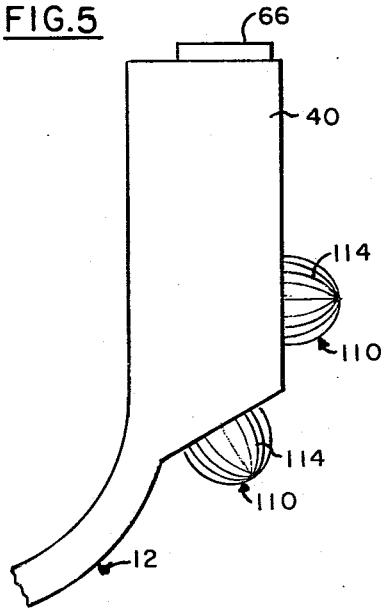
FIG. 5 is a partial planned view of the side of the shoe mounted lighting device of the present invention illustrating the use of surface mounted light sources.

With respect to FIG. 5, there is illustrated a partial planned view of a further embodiment of the present invention in which certain surface mounted diffusers 110 and 112 containing light sources (not shown) can be used to confine the light source closer to the shoe of the wearer and still obtain viewability at a greater than 180 degree angle front, side, and rear.

Diffusers 52, 54, 110 and 112 can utilize internal prismatic members 114 to provide a directional control of the light emitted by the light sources contained therein to thus provide more efficient use of the light flux generated.

It can also be seen that straps 34 can be molded out of the same elastomer material 22 as covering spring 16. Straps 34, thus molded, can also be provided with integral holes and catches (not shown) which can be used to adjust the tension and provide the ability to attach illuminating device 12 to the various size shoes.

We claim:

1. A shoe mounted lighting device comprising:

a generally U-shaped member adapted to engage a shoe proximate the heel thereof, at least one battery, means defining a container connected to said U-shaped member, said container adapted to house at least one battery, means defining a first receptacle connected to said U-shaped member proximate the side of said U-shaped member, the axis of rotation of said receptacle projecting outwardly to the side of said shoe when said U-shaped member is engaged thereon, an incandescent light source, a rigid extension member having longitudinal axis of rotation, a first end and a second end comprising a plug member attached proximate said first end of said extension member, said plug adapted to engage and be received by said first receptacle with said longitudinal axis of rotation being coincident with the axis of rotation of said receptacle, a second receptacle attached proximate said second end of said extension member and adapted to receive and engage said incandescent light source, and means for electrically connecting said incandescent light source to said container and said battery.

2. A lighting device to be worn by a person comprising:

at least one battery, means defining a housing adaped to contain said battery, a socket attached to said housing for said batteries, an incandescent light source, a projection-extension member projecting outwardly from said housing and having one end adapted to engage and be received by said socket attached to said housing and having its other end adapted to receive and engage said incandescent light source, means for electrically connecting said light source to said batteries, means for attaching said housing proximate the lower portion of the leg of said person, said projection-extension member projecting outwardly from the side of the leg of said person said light source attached to the outwardly extended end of said projection-extension member and visible at least 180 degrees front to rear of said person.

3. A lighting device comprising:

a generally U-shaped resilient member comprising an elastomer covered U-shaped spring member having its legs biased to engage a shoe proximate the heel thereof, at least one battery, means defining a battery container disposed along one leg of said U-shaped member, and a lighting assembly attached to said battery container said lighting assembly being visible from the front, side and rear of said U-shaped member, said lighting assembly comprising an extension member adapted to project outwardly from said battery container having a first end and a second end, a plug member disposed proximate said first end of said extension member, a light source, a receptacle member adapted to receive said light source disposed proximate said second end of said extension member and be disposed a predetermined distance away from said battery container, and means for connecting said light source to said battery.

* * * * *